United States Patent [19]

Leibowitz

[11] Patent Number: 4,922,986

[45] Date of Patent: May 8, 1990

[54] VERTICAL BLIND SPACER

[76] Inventor: Martin N. Leibowitz, 1155 Hillsboro Mile (A1A) Suite 602, Hillsboro Beach, Fla. 33062

[21] Appl. No.: 249,505

[22] Filed: Sep. 26, 1988

[51] Int. Cl.[5] ..... E06B 9/36

[52] U.S. Cl. ..... 160/178.1; 160/173; 160/900; 24/16 PB; 24/300; 24/711.5

[58] Field of Search ..... 160/178.1, 900, 168.1, 160/349.1, 173; 24/16 PB, 300, 301, 302, 104, 90 B, 711.5

[56] References Cited

U.S. PATENT DOCUMENTS

| | | | |
|---|---|---|---|
| 1,270,494 | 6/1918 | Christiansen | 24/302 |
| 2,756,817 | 7/1956 | Toti | 160/900 X |
| 3,595,506 | 7/1971 | Saunders | 24/16 PB X |
| 4,053,009 | 10/1977 | Edlin | 24/16 PB X |
| 4,407,350 | 10/1983 | Nakamura | 160/178.1 |
| 4,529,025 | 7/1985 | Oskam | 160/178.1 |
| 4,686,783 | 8/1987 | Bourquard et al. | 24/16 PB X |
| 4,696,336 | 9/1987 | Dixon | 160/178.1 |

FOREIGN PATENT DOCUMENTS

| | | | |
|---|---|---|---|
| 596190 | 4/1960 | Canada | 24/16 PB |
| 3303715 | 8/1984 | Fed. Rep. of Germany | 160/178.1 |
| 7609987 | 3/1978 | Netherlands | 160/178.1 |

*Primary Examiner*—David M. Purol

*Attorney, Agent, or Firm*—Richard M. Saccocio

[57] ABSTRACT

Apparatus for spacing and connecting the bottoms of individual blinds of a vertical blind arrangement is disclosed. A flexible member having a male connector half at one end and a female connector half at the other end is positioned between individual blinds such that the male connector of one flexible member connects with the female connector of the adjacent flexible member and captures an individual vertical blind therebetween.

7 Claims, 3 Drawing Sheets

VERTICAL BLIND SPACER

BACKGROUND OF THE INVENTION

1. Field of the Invention

This invention relates in general to the field of vertical blinds and in particular to the connector-spacer arrangement at the bottom of the blinds for maintaining an even distance between adjacent blind segments.

2. Description of the Prior Art

The spacing between vertical blind segments of a vertical blind arrangement is controlled by the track arrangement at the upper end of the blind arrangement. In general when a vertical blind arrangement is drawn across a window or other opening, the spacing between individual vertical blinds is in accordance with the track arrangement attachment of each of the vertical blinds. In one track arrangement, each vertical blind is attached to a slider which is attached to the pull cord within the track arrangement. The sliders are evenly spaced along the length of the cord so that when the blinds are drawn across the opening, there results an even spacing between the individual blind segments. There are other vertical blind track arrangements such as gates and hooks, which operate differently from the above, but the result is the same, that is, they provide even spacing at the top of the blind arrangement. A linking arrangement attached to the bottom end of the vertical blinds regardless of the upper track arrangement, in the prior art, consists of a passive chain which is very flexible and which is attached to the bottom end of each vertical blind along equally spaced portions of the chain. The linking chain arrangement is passive in that the spacing between blind segments is, as explained above, controlled by the upper track arrangement. The bottom linking chain arrangement merely provides the individual blind segments with an attachment to an elongated device (the chain) which maintains the spacing set by the upper track arrangement. The object, of course, being to maintain the individual blind segments in a parallel orientation with regard to adjacent blind segments when the blinds are drawn across the opening. Without the bottom linking arrangement, wind or even gentle breezes would cause the individual blind segments to sway back and forth, and thereby disrupt the orderliness of the parallel spacing between the adjacent blind segments. Further, the blinds may tangle with each other or twist and catch each other without the aid of a bottom linking arrangement.

For stiff vertical blind segments, such as those made from plastic, the linking bottom arrangement often comprises a bead type of chain which is strung through openings at the bottom end of the blinds. With stiff blind segments, a keyhole type of opening for the chain is utilized. The larger upper opening allows a chain to pass through a blind segment while the lower smaller opening provides for fitting therein of the links between adjacent beads of the chain. Since the beads cannot pass through the smaller opening, a "lockable" arrangement results. For flexible blind segments, such as those made from a decorative cloth material, the linking bottom arrangement is more complicated.

The simple bead chain arrangement is not possible with flexible blind segments because of the flexibility of the material A metal weight is usually attached to the bottom end of the flexible blind segments so that individual blind segments hang straight in a downward fashion. Because of the metal weight, a keyhole type of opening at the bottom end of the flexible blind segments would not provide for the same "locking" of a bead chain. Accordingly, a clip is most often used, which clip is attached to the bead chain and which may then be secured to the metal weight at the bottom end of a flexible blind segment. In this arrangement the clip provides for the locking of the bead chain and the attachment of the chain to the blind segment.

In practice, it is common with flexible blinds for a bead chain with a plurality of clips attached thereto and spaced along the length of a bead chain to be attached to the lower side edges of the metal weights. Thus, two bead chains with clips are used at the bottom of such flexible blind segments. Two bead chains are used rather than just one because one edge chain will not control fanning of the blind segments on the side opposite the chain. While a pair of bead chains with clips attached thereto may be satisfactorily used to space and connect the bottom ends of the flexible blinds, the costs of manufacturing such chains are quite high—especially as compared to the simple bead chain of the stiff or non-flexible type of vertical blind segments. Accordingly, a primary object of the present invention is to provide a flexible linking arrangement which may be used with both stiff and flexible blind segments and yet be inexpensive to manufacture.

Another object of the present invention is to eliminate the unsightly appearance caused by the use of the prior art and steel weights and two pairs of chains and clips.

Another object of the present invention is to eliminate the use of bead chains at the bottom of vertical blinds and thereby eliminate the breakage usually associated therewith.

Another object of the present invention is to provide a degree of resiliency between the bottom connections of adjacent vertical blind segments.

The above-stated objects as well as other objects which although not specifically stated, but are intended to be included within the scope of the present invention, are accomplished by the present invention and will become apparent from the hereinafter set forth Detailed Description of the Invention, Drawings, and the Claims appended herewith.

SUMMARY OF THE INVENTION

The above objects, as well as others, are accomplished by the present invention which provides a resilient linking and spacing arrangement for the bottom of either stiff or flexible blind segments whereby only one linking arrangement is used at the center of the width of the individual blind segments.

The linking arrangement provided by the present invention comprises individual flexible and resilient spacers of an appropriate strand of material having a male connector at one end and a female connector at the other end. The length of the strand of material is slightly larger than the maximum spacing between opened vertical blind segments. Each individual linking spacer is attached between vertical blind segments such that the male connector at the end of one linking spacer mates with the female connector of the adjacent linking spacer. The male connector of the adjacent linking spacer then fits within and attaches to the female connector of the next adjacent linking spacer. This arrangement continues throughout the plurality of spaces between individual blind segments making up the vertical blind arrangement. As provided by this invention, the material from which the individual blind segments is made is captured between a male and a female connector on opposite sides of the blind segment. Moreover, the attachment of the male and female connectors is accomplished at the center of the width of each of the blind segments so that only one cord or chain-like linking arrangement is used rather than the two of the prior art.

The strand of material connecting each of the male and female connectors is attached to the circumferential periphery of each of the connectors which may be offset with regard to the axis of the connectors which extends between the axial center of the connectors. This offset and orientation provides for additional non-interference of the connecting linking spacer strand when the blind segments are stacked together. This allows for minimum non-interfering spacing between the bottoms of each of the stacked blind segments. Also, the faces of the male and female connectors are oriented with regard to each other when the linking spacer is in the relaxed, unassembled condition, such that the female connector and the male connector face in opposite directions.

This orientation of the connectors requires that one of the connectors be rotated 180° when fitting the linking spacer between adjacent vertical blind segments. The twisting in turn causes automatic coiling of each of the connecting strands in a substantially vertical plane orientation and parallel to the flat plane of the blind segments.

To facilitate installation of the male and female connectors on either side of the individual blind segments, a guiding awl may be utilized. One end of the awl has a small diameter shaft extending therefrom which fits into a central opening provided in the male connector. The other end of the awl comprises an elongated cone tapering in diameter from the apex end opposite the shaft end to a maximum diameter that it is equal to or slightly larger than the maximum diameter of the male portion of the male connector. When a male connector is attached to the shaft end of the guiding awl, the tapered extending other end of the awl may be pushed through an opening in the bottom part of the blind segments which clears the way for the male end of the male connector to be inserted through the opening in the blind segment. With the awl and the male connector still attached thereto in place within the opening at the bottom end of the blind segment, the female connector from the adjacent blind segment is pushed over the extending tapered circumference of the awl and into mating engagement with the male connector. Then the awl may be removed from the connected connectors and is thereafter utilized to join all the other male and female connectors in the linking arrangement.

BRIEF DESCRIPTION OF THE DRAWINGS

Various other objects, advantages and features of the invention will become apparent to those skilled in the art from the following discussion taken in conjunction with the following drawings, in which.

DESCRIPTION OF THE PREFERRED EMBODIMENTS

Figure 1:
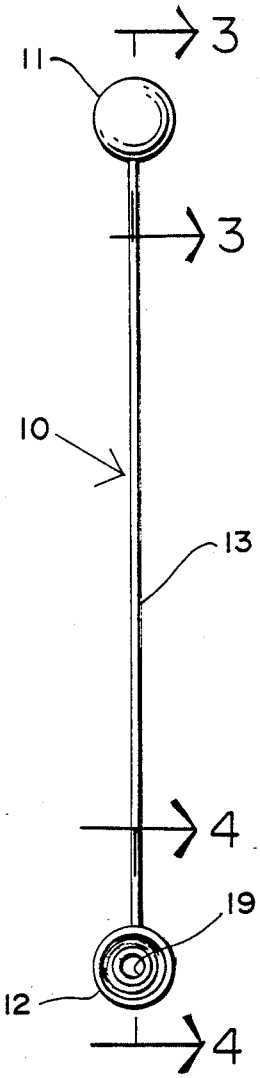
FIG. 1 is a plan view of a preferred embodiment of the inventive linking spacer for a vertical blind arrangement as provided by the present invention.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings wherein like characteristics and features of the present invention shown in the various figures are designated by the same reference numerals.

Figure 2:
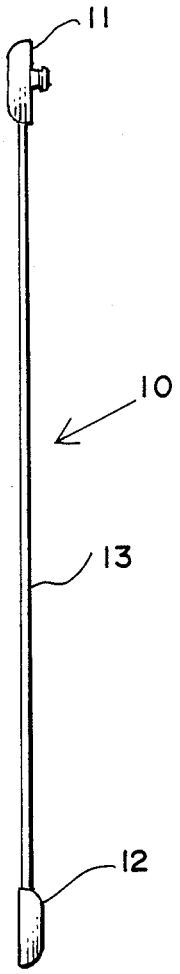
FIG. 2 is a side view of the inventive linking spacer of FIG. 1.

Referring now the drawings, specifically FIGS. 1 and 2 thereof, which together show a side and a frontal view of one embodiment of the inventive vertical blind linking spacer. The linking spacer 10 comprises a male connector 11 at one end thereof and a female connector 12 at the other end thereof, which is separated by a flexible elastic cord member 13

Figure 3:
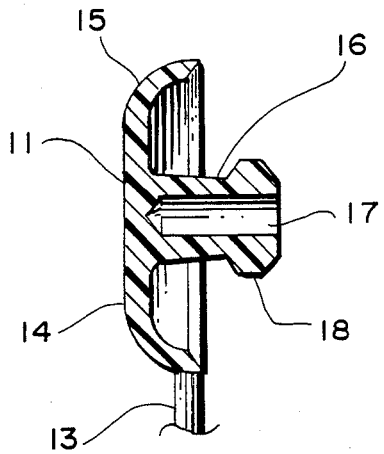
FIG. 3 is a cross-sectional view of the male connector of FIG. 1, taken through the line 3—3 thereof.
Figure 4:
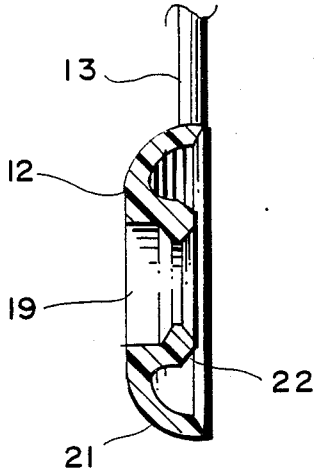
FIG. 4 is a cross-sectional view of the female connector of the linking spacer of FIG. 1, taken along the line 4—4 thereof.

The cross-sectional shape of the male 11 and the female 12 connectors are shown in FIGS. 3 and 4 of the drawings. Referring now also to these drawings, it is seen that the male connector 11 comprises a circular disk having a flat inner portion 14 and a curved peripheral portion 15. Curved peripheral portion 15, in cross section, curves away and down from flat portion 14 such that an approximate one-quarter of a hollow sphere obtains around the flat portion 14 of male connector 11. As will be more fully explained hereinafter, the curved peripheral portion 15 provides for the use of the connector-spacer 10 in conjunction with vertical blinds made of differing thicknesses of material.

An elongated shaft 16 emanating from the inside center of flat portion 11 extends from the inside thereof in the same direction as the curved peripheral portion 15. Shaft member 16 extends beyond the end of downwardly curved peripheral portion 15. A blind opening 17 is provided within the interior of extending shaft member 16. A flange member or portion 18 is provided at the free end of shaft 16 for purposes of interconnectingly connecting with a similarly shaped but reversed flange portion on the female connector 12.

Male connecting member 11, female connecting member 12 and the flexible member 13 may be made from a very soft, flexible, plastic or rubber material which is elastic and resilient, such as clear PVC having a hardness of approximately 52 durometer (Shore durometer, A scale). A soft flexible material is preferred because it serves to conform to the spacings between vertical blind members rather than dictate the spacing between the same. Yet, when the inventive linking spacer 10 is provided at the bottom end and between each of the vertical members of a blind configuration, a flexible material, such as that specified, serves to properly maintain the spacing between adjacent members of a vertical blind configuration.

Female connector 12 comprises a round disk-like member having an opening 19 therethrough and a downwardly curved peripheral portion 21 which is virtually identical to peripheral portion 15 of the male connector 11. Peripheral portion 21 also comprises an approximate one-quarter of a hollow sphere at the inside of the female connector 12. An inner flange member or portion 22 is connected to female connector 12 along the circumferential periphery of opening 19. Flange member 22 extends from the inside of female connector 12 in the same direction as peripheral portion 21 but curves inward toward the central axis of connector 12.

Male member 11 and female member 12 face opposite to each other as shown in FIGS. 1 and 2 when linking spacer 10 is in a relaxed and unassembled position.

Figure 7:
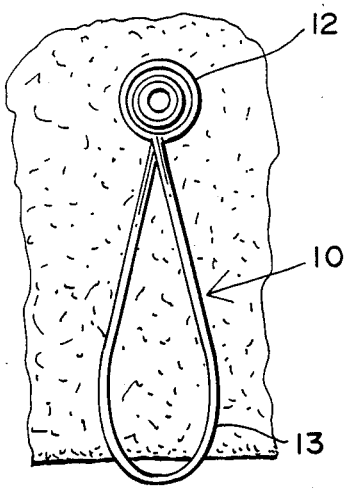
FIG. 7 is a side view of the stacked together blind segments taken along the line 7—7 of FIG. 6 illustrating the coiling orientation achieved by the inventive liking spacer.
Figure 6:
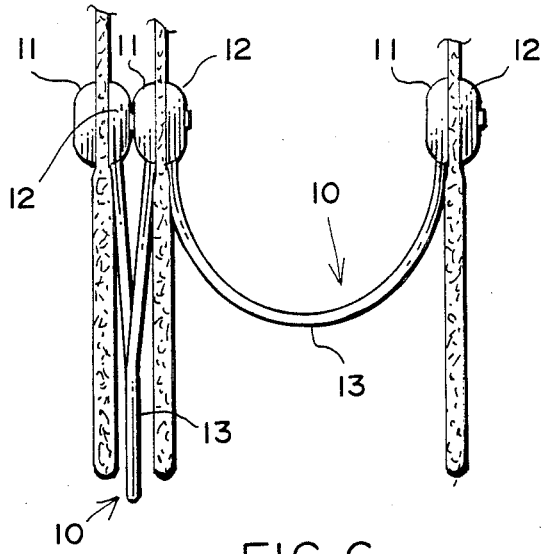
FIG. 6 is and end view of the bottom part of a flexible drapery arrangement utilizing the linking spacer of the present invention.

The unique orientation of flexible member 13 with respect to male member 11 and female member 12 and the oppositely-facing male 11 and female 12 members as provided herein is for the following purposes: preventing interference between looped portions of the flexible member 13 which it assumes during stacking of the vertical blind members as shown in FIGS. 6 and 7 of the drawings; and, for assuring that the coiled loop formed by flexible member 13 lies in a vertical plane parallel to the planes of the vertical blind segments. This noninterference between the respective portions of flexible member 13 and the vertical plane orientation of flexible member 13 when coiled allows the vertical blind members to be stacked close to each other without being affected by the inventive linking spacer 10.

Figure 9:
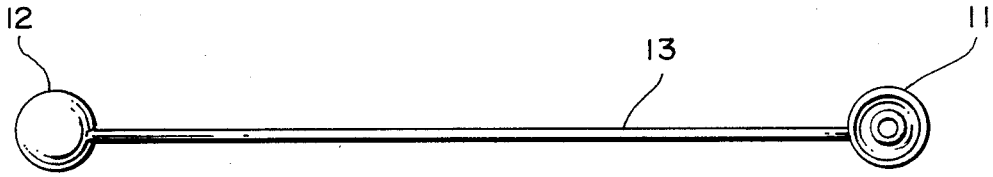
FIG. 9 is a schematic representation of the linking spacer of FIG. 1 shown in a relaxed state.
Figure 10:
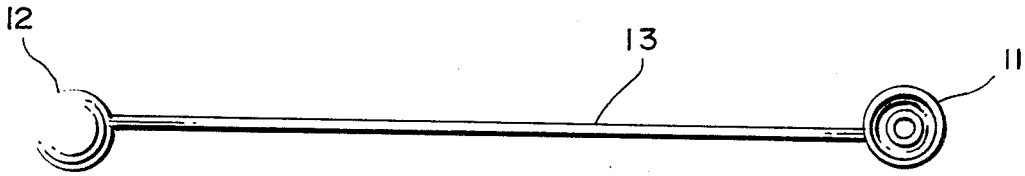
FIG. 10 is a schematic representation of the linking arrangement of FIG. 9 shown in an orientation achieved prior to installing the linking spacer between blind segments.

FIGS. 9 and 10 schematically illustrate the inventive linking spacer of FIG. 1 as arranged for assembly between adjacent vertical blind segments. FIG. 9 shows the linking spacer in a relaxed, as manufactured position. Female connector 12 faces downward, while male connector 11 faces upward (both face in opposite directions). In FIG. 10 the male connector 11 has been rotated 180° over its length. This twist causes flexible member 13 to form a loop as shown in FIGS. 6 and 7, which loop is parallel to the plane of the vertical blind segments.

Figure 5:
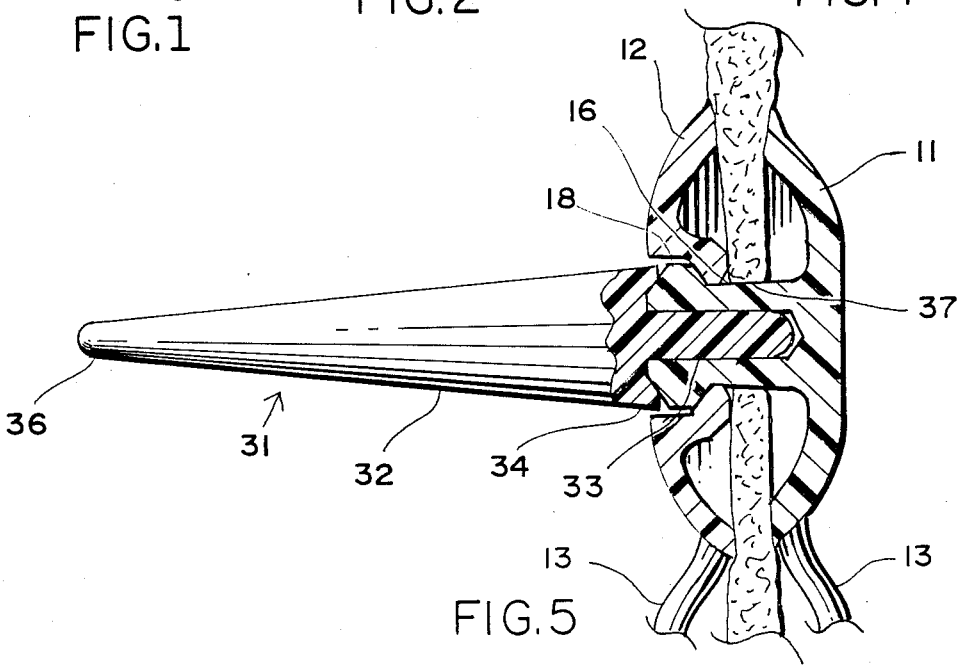
FIG. 5 is a cross-sectional view of mating male and female connectors which are located at opposite sides of an individual blind segment along with the use of a guiding awl.

Since male member 11 and female member 12 are made from a very flexible and soft elastic material, it may be somewhat difficult to assembly the male connector 11 of one linking spacer 10 into the female member 12 of the linking spacer on either side thereof and between adjacent vertical blind members. In order to facilitate such installation, an awl 31, as shown in FIG. 5, may be utilized. Awl member 31 comprises a tapered cylindrical portion 32 and a smaller right cylindrical or shaft portion 33.

The right cylindrical portion 33 is designed to fit within the blind opening 17 of male connector 11. The diameter of tapered cylindrical portion 32 at the base 34 thereof is substantially equal to the outer diameter of flange member 18 at the end shaft 16 of male connector 11. When the right cylindrical portion 33 is inserted within blind opening 17 of male connector 11 as shown in FIG. 5 of the drawings, cylindrical portion 33 prevents the collapsing of shaft 16 while allowing connection of awl 31 to male member 11 When such connection is made, the female member 12 of an adjacent linking spacer 10 is ready to be assembled to the male connector 11. It is to be noted that a thickness of a vertical blind member is to be attached between a connected female member 12 and male member 11.

The tapered and pointed end 36 of awl 31 is inserted within small opening 37 or forms a small opening 37 at the bottom end of a vertical blind member and pushed therethrough such that the progressively larger circumference of awl 31 enlarges the opening 37 to the point that the largest diameter 30 of awl 31 passes through opening 37 along with the flange portion 18 of shaft 16 of male member 11. In this manner the flange member 18 having a larger diameter than the initial diameter of opening 37 may be caused to pass through opening 37. The connection of the female member 12 of the adjacent linking spacer 10 is then effectuated by fitting opening 19 over the tapered and pointed end 36 of awl 31 while holding male member 11 in place. Pushing of female member 12 is continued until such time as the flange member 22 thereof fits over the base portion 34 of awl 31 and over and beyond the flange 18 of male member 11. The elasticity of the material of linking spacer 10 allows flange 22 of female member 12 to be elastically deformed and inserted over flange member 18. Upon full travel of the female member 12 and flange 22 thereof past flange 18 of male member 11, flange 22 reverts to its non-stressed shape and closes in behind flange 18 thereby locking the female member 12 with male member 11 as shown in FIG. 5 of the drawings. Awl 31 may thereafter be removed and used to facilitate the connection of the other male and female connectors.

Figure 13:
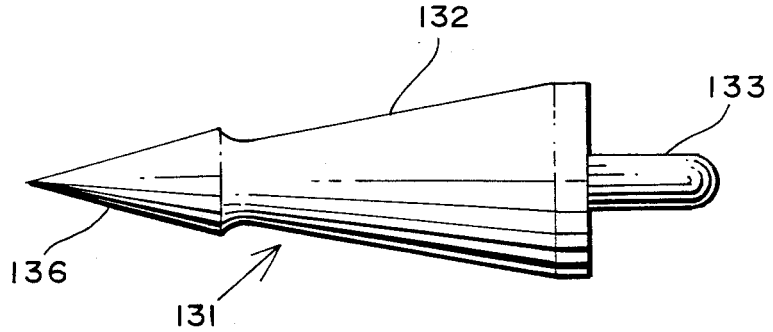
FIG. 13 is a plan view of an alternative embodiment of a guiding awl.

An additional embodiment of an awl member is shown in FIG. 13. Awl member 131 includes a lance-like tip 136 which when combined with the tapering body of 132 of awl 131, allows a person to positively grip awl 131 when inserting shaft 133 into the opening 17 of a male member 11.

While an assembly device such as awl 31 or awl 131 may be used to facilitate assembly, the invention is not to be limited thereby. A male member 11 and a female member 12 may be assembled together without the use of an assembly device such as awl 31, by a person using only his hands.

The cuplike shapes of male member 11 and female member 12 due to the curved peripheral portions 15 and 21, respectively, allow for connection of male member 11 to female member 12 regardless of the thickness of vertical blind member 38. The ability of the curved peripheral portions 15 and 21 to elastically deform provides for such connection to a thicker vertical blind as shown in phantom in FIG. 5 of the drawings. In this regard it is to be observed that a non-cupped configuration of male member 11 and female member 12 may be utilized for a vertical blind member having a thickness which is non-variable and comprises the designed spaced-apart dimension between such non-cupped mating male and female connectors.

The mating female 12 or male 11 member at each end of the vertical blind arrangement may be obtained be simply snipping off the flexible member 13 so that just a male member 11 or a female member 12 may be used. See FIG. 7.

The oppositely-facing orientation of male member 11 and female member 12 as shown in FIGS. 1 and 2 of the drawings, are provided, as stated above, to prevent interference of linking spacer 10 between stacked blind segments and to provide a vertical posture of a coiled flexible member 13 as shown in FIGS. 6 and 7 of the drawings. The face-to-face orientation of connected pairs of male members 11 and female members 12 requires that either of the members be rotated 180° relative to the other and such that the outside faces of each member face each other in order to be fitted between adjacent vertical blind members of a vertical blind arrangement. This 180° twisting causes a loop to be formed as shown in FIG. 7 whereby the portions of flexible member 13 at its connection to male member 11 and female member 12 did not interfere with each other. This allows adjacent vertical blind members to be spaced from each other in a stacked position by a distance equal to the thickness of male member 11 and female member 12 while the bottom portions of the stacked vertical blind members, which are fitted with weights, are separated from each other by the thickness of flexible member 13. Such orientation further provides for consistent formation of a loop when the vertical blind members are being stacked and thereby provide for uniformity of appearance of the looped portions of linking spacer 10.

Figure 8:
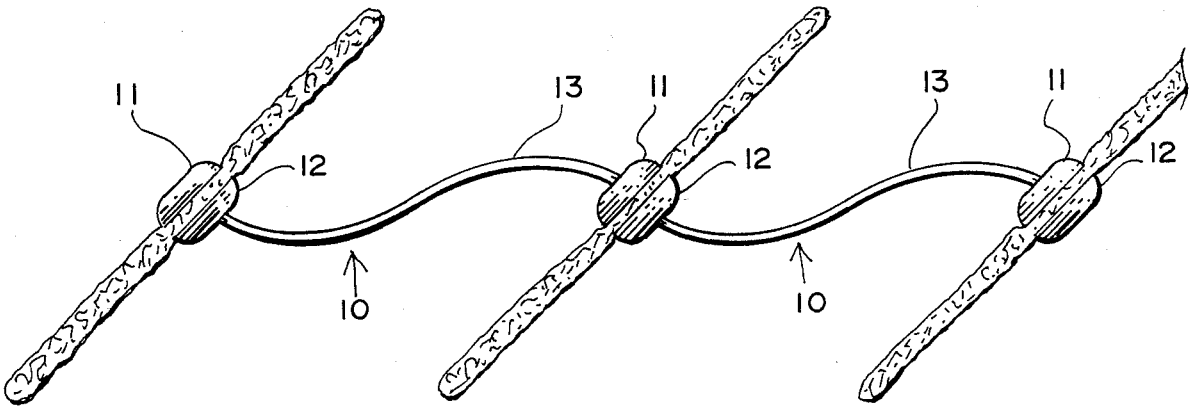
FIG. 8 is a top view of typical vertical blinds being angled closed illustrating the control provided by the inventive linking spacer.

When some or all of the vertical blind members are drawn across an opening, the flexible member 13 attains the curved shape as shown in FIG. 7 of the drawings. When the vertical blind members are turned to block the opening, the flexible members 13 readily twist to allow the blinds to turn without any appreciable interference from flexible members 13 as shown in FIG. 8 of the drawings.

Figure 11:
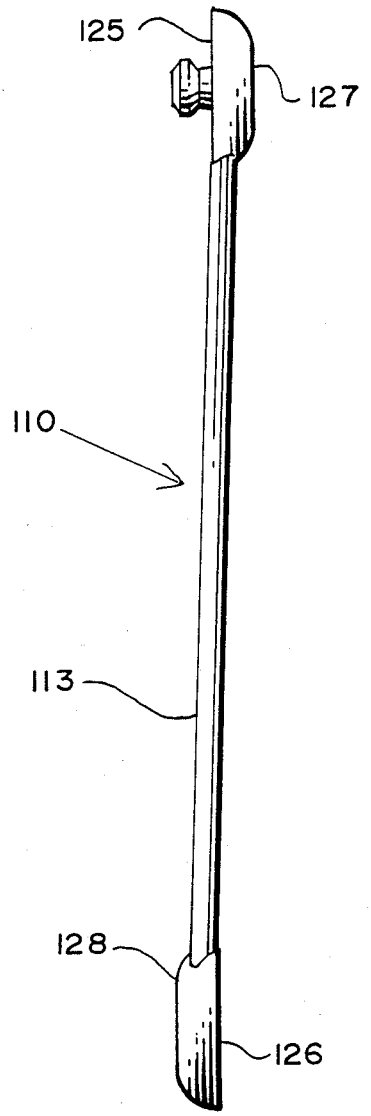
FIG. 11 is a plan view of another embodiment of the inventive linking spacer illustrating an offset arrangement.
Figure 12:
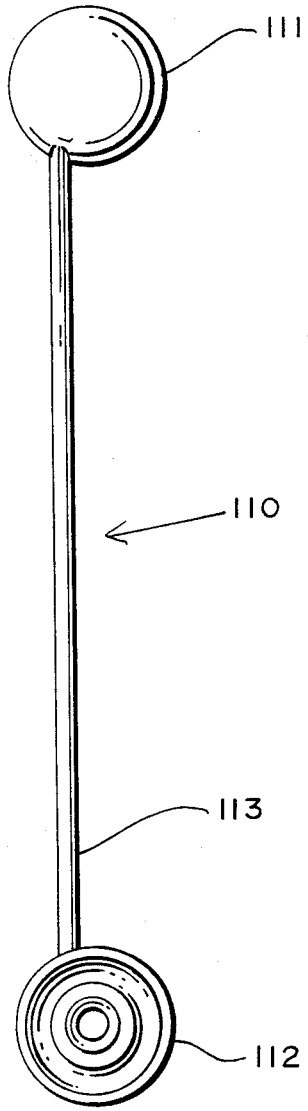
FIG. 12 is a side view of the linking spacer of FIG. 11.

FIGS. 11 and 12 illustrate another embodiment of the present invention. Referring now to these figures, it is seen that the angled offset of flexible member 13 when twisted as per FIG. 10, provides for a clearance above and below the line connecting the center lines of members 111 and 112. When members 111 and 112 are then connected between adjacent vertical segments, the rotation of member 111 and the twist of flexible member 113 is maintained. Thus, when the vertical blind segments are stacked together as shown in FIGS. 6 and 7, the twist in the flexible member 113 causes flexible member 113 to form in a loop configuration which is parallel to the planes of the vertical blind segments. The angled offset provides for clearance to be present between the connection of flexible member 113 to members 111 and 112. This clearance D provides for additional non-interference above-stated.

Flexible member 113 is connected between male connector 111 and female connector 112 such that it is slightly offset relative to the line connecting the vertical axis of male connector 111 and female connector 112 and such that it is parallel to said line connecting the vertical axes. The amount of offset may be approximately equal to one-to-two diameters of the flexible member 113.

The attachment of flexible member 113 to male connector 111 and female connector 112 is shown in plan view in FIG. 11 and in side view in FIG. 12. In FIG. 12 it is seen that male connector 111 and female connector 112 are arranged such that the inner faces 125 and 126 of members 111 and 112, respectively, lie in the same vertical plane and that the outside faces 127 and 128 face away from each other. Thus, in its relaxed state before being attached to vertical blind members, the male 111 and female 112 connectors of linking spacer 110 face opposite to each other with the flexible member 113 being offset with respect to the oppositely-facing male and female members 111 and 112. Male member 111, female member 112 and flexible member 113 may be integrally attached to each other as provided by a one-piece molded member. The unique offset orientation of FIGS. 11 and 12 additionally provide for preventing interface between looped portions and additionally assuring vertical plane orientation of rolled loops.

The assembly of the embodiment of FIGS. 11 and 12 is the same as for the embodiment of FIGS. 1 and 2 and as described above.

When the vertical blinds using the embodiment of FIGS. 11 and 12 are stacked together, the resulting coil formed by flexible member 113 will again look and be positioned as shown in FIG. 7. The flexible features of flexible member 113 will allow a substantially single thickness equal to the diameter of flexible member 113 to exist between the stacked bottom ends of the vertical blind segments. The portion of flexible member 113 to members 111 and 112 will form around the thickened upper end of the weights at the bottom of the vertical blind segments. In substantially all other respects, the use and function of the embodiment of FIGS. 11 and 12 will be the same as the embodiment of FIGS. 1 and 2.

While the invention has been described, disclosed, illustrated and shown in certain terms or certain embodiments or modifications which is has assumed in practice, the scope of the invention is not intended to be nor should it be deemed to be limited thereby and such other modifications or embodiments as may be suggested by the teachings herein are particularly reserved especially as they fall within the breadth and scope of the claims here appended.

I claim:

1. In a vertical blind arrangement having a plurality of vertical blind members depending therefrom for accumulation, one or more spacers, each of said spacers being secured to two adjacent vertical blind members at the bottom thereof for spacing and connecting the vertical blind members, wherein, each of said spacers comprise:

an elongated flexible member having a female connector half at one end and a male connector half at the other end thereof:

each of said connector halves having a cuplike shape and means for forming a variable space between facing sides of said connector halves when said connector halves are mated together;

said male connector half comprises a hollow spherical segment member defining said cuplike shape and a shaft member attached to said spherical segment and extending in a direction away from the hollow inside thereof of said spherical segment member;

said female connector half comprises a hollow spherical segment member defining said cuplike shape and having an opening through the center thereof;

said male connector half has a connection side which faces in a first direction and a non-connection side which faces in a second direction;

said female connector has a connection side which faces in said second direction and a non-connection side which faces in said first direction.

2. The apparatus of claim 1, wherein said flexible member is attached to said connector halves such that a longitudinal center line of said flexible member substantially coincides with a line connecting a central axis of each of the connector halves.

3. The apparatus of claim 1, wherein said flexible member is attached to said connector halves such that a longitudinal center line of said flexible member is parallel and offset to a line connecting a central axis of each of the connector halves.

4. The apparatus of claim 1, including means for snap fitting the male connector of one of said spacers to the female connector of another one of said spacers.

5. The apparatus of claim 4, wherein said means for snap fitting the male connector of one of said spacers to the female connector of another one of said spacers comprises a first flange extending along the periphery of said opening of said female connector, a second flange disposed around the circumference of said shaft member of said male connector, wherein, said first and second flanges cooperate with each other for securing the male connector of one of said spacers to the female connector of another one of said spacers.

6. The apparatus of claim 1, wherein said variable space forming means comprises a flexible periphery portion on at least one of said hollow spherical segments of said connector halves.

7. The apparatus of claim 6, wherein each of said connecting halves have an outer dimension at the location of said flexible peripheral portion, substantially equal to each other.

* * * * *